US006658885B1

(12) United States Patent
Zhou et al.

(10) Patent No.: US 6,658,885 B1
(45) Date of Patent: Dec. 9, 2003

(54) ROTARY COMPRESSOR WITH MUFFLER DISCHARGING INTO OIL SUMP

(75) Inventors: Wei Zhou, Indianapolis, IN (US); Mark A. Daniels, Manlius, NY (US); Scott P. Mullin, Ellington, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/262,732

(22) Filed: Oct. 2, 2002

(51) Int. Cl.[7] ..... F25D 19/00; F25B 43/02

(52) U.S. Cl. ..... 62/296; 62/472; 181/403; 417/312

(58) Field of Search ..... 62/296, 469, 472; 181/403; 417/312

(56) References Cited

U.S. PATENT DOCUMENTS

| | | | | | |
|---|---|---|---|---|---|
| 1,897,199 | A | * | 2/1933 | Kenney | 418/96 |
| 2,084,341 | A | * | 6/1937 | Hornaday | 62/181 |
| 3,031,861 | A | * | 5/1962 | McCormack | 62/196.3 |
| 3,066,857 | A | * | 12/1962 | MoCloy | 417/363 |
| 4,061,444 | A | * | 12/1977 | Dirk et al. | 417/312 |
| 4,907,414 | A | * | 3/1990 | Fraser et al. | 62/56 |
| 5,605,447 | A | * | 2/1997 | Kim et al. | 417/312 |

* cited by examiner

*Primary Examiner*—William E. Tapolcai

(57) ABSTRACT

The entire discharge flow in a high side, vertical, hermetic rotary compressor is directed into the oil sump which generates foam for sound attenuation and heats the oil to reduce its viscosity and to drive off refrigerant dissolved in the oil.

4 Claims, 4 Drawing Sheets

ROTARY COMPRESSOR WITH MUFFLER DISCHARGING INTO OIL SUMP

BACKGROUND OF THE INVENTION

Commonly assigned U.S. Pat. Nos., 4.900,234; 4,907,414 and 5,077,981 each disclose a low side hermetic compressor in which a portion of the discharge of the compressor is bled into the oil sump. The high pressure gas being bled into the oil sump represents a loss but, because the interior of the compressor shell and the oil sump are at suction pressure, the foam generated by the high pressure gas expanding to suction pressure in the oil provides sound attenuation.

Discharge gas pulsation in the shell cavity beneath the motor in a high side vertical, hermetic rotary compressor has been found to be one of the major noise sources. In current compressor designs, the compressed gas discharges from the pump structure into the muffler cavity and then passes into the lower shell cavity. The discharge gas passes from the lower shell cavity to the discharge at the top of the compressor shell by passing through the gap between the rotor and stator and/or passing through passages between the stator and the compressor shell.

SUMMARY OF THE INVENTION

According to the teachings of the present invention the discharge gas in a high side rotary compressor passes from the pump structure into the muffler cavity and then passes via tubes into the oil sump located beneath the pump structure. Discharging the hot high pressure gas into the oil sump heats the oil and thereby reduces its viscosity. Additionally, the discharging of the high pressure gas into the oil sump, which is also at discharge pressure, generates foam roughly in the volume of the gas discharged from the pump structure. The foam will pass from the oil sump, through the pump structure to the upper part of the lower shell cavity, i.e. the part below the motor. Any foam entering the gap between the rotor and stator will tend to be collapsed and the oil will tend to be centrifugally separated such that it collects on the stator and drains due to gravity.

It is an object of this invention to reduce rotary compressor noise due to discharge gas pulsation.

It is another object of this invention to provide additional attenuation without reducing efficiency.

It is a further object of this invention to improve oil lubrication capability by increasing oil temperature in the sump. These objects, and others as will become apparent hereinafter, are accomplished by the present invention.

Basically, the entire discharge flow in a high side, vertical, hermetic rotary compressor is directed into the oil sump which generates foam for sound attenuation and heats the oil to reduce its viscosity and to drive off refrigerant dissolved in the oil.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
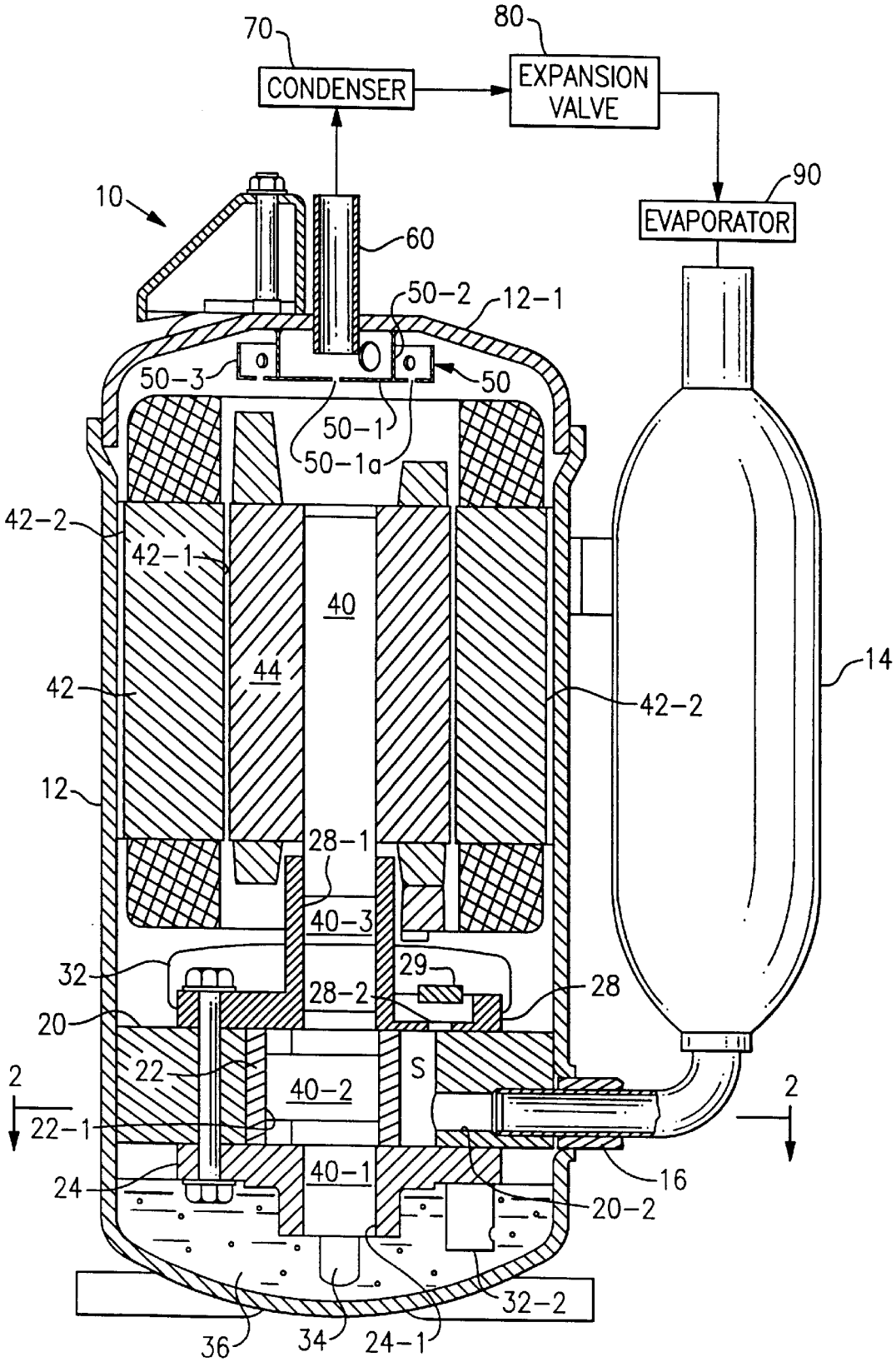
FIG. 1 is a partially sectioned view of a compressor employing the present invention schematically located in a refrigeration circuit.

In FIGS. 1–3 and 5, the numeral 10 generally designates a vertical, high side, rolling piston compressor. Compressor 10 is in a refrigeration circuit serially including compressor 10, discharge line 60, condenser 70, expansion valve 80 and evaporator 90. The numeral 12 generally designates the shell or casing. Suction tube 16 is sealed to shell 12 and provides fluid communication between suction accumulator 14, which is connected to evaporator 90, and suction chamber S. Cylinder 20, piston 22, pump end bearing 24, motor end bearing 28 and vane 30 collectively make up the pump structure. Suction chamber S and compression chamber C are defined by bore 20-1 in cylinder 20, piston 22, bearings 24 and 28, and vane 30 which separates suction chamber S and compression chamber C.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by a shrink fit, welding or any other suitable means. Commonly there will be passages in the form of slots or grooves 42-2 in the outer surface of the stator 42 running its entire length to provide flow paths for refrigerant gas across the motor defined by stator 42 and rotor 44 and for the return flow of oil to oil sump 36. Rotor 44 is suitably secured to shaft 40, as by shrink fit, and is located within bore 42-1 of stator 42 in a spaced relationship and coacts therewith to define a variable speed motor. Vane 30 is biased into contact with piston 22 by spring 31.

Figure 3:
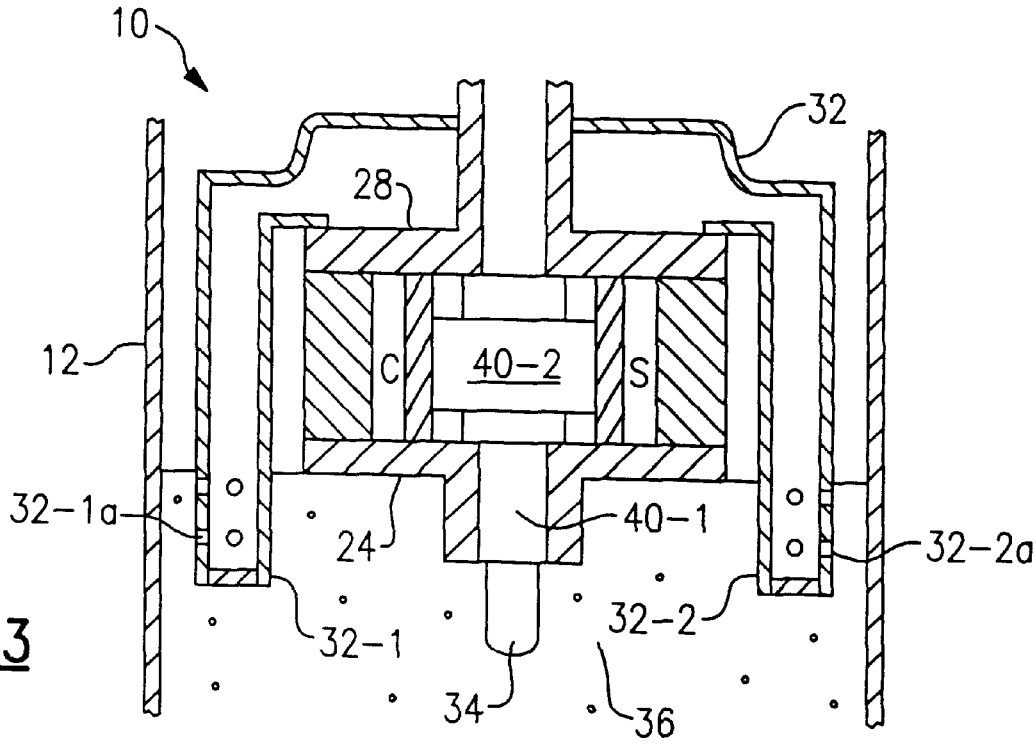
FIG. 3 is a sectional view taken along line 3—3 of FIG. 2.
Figure 4:
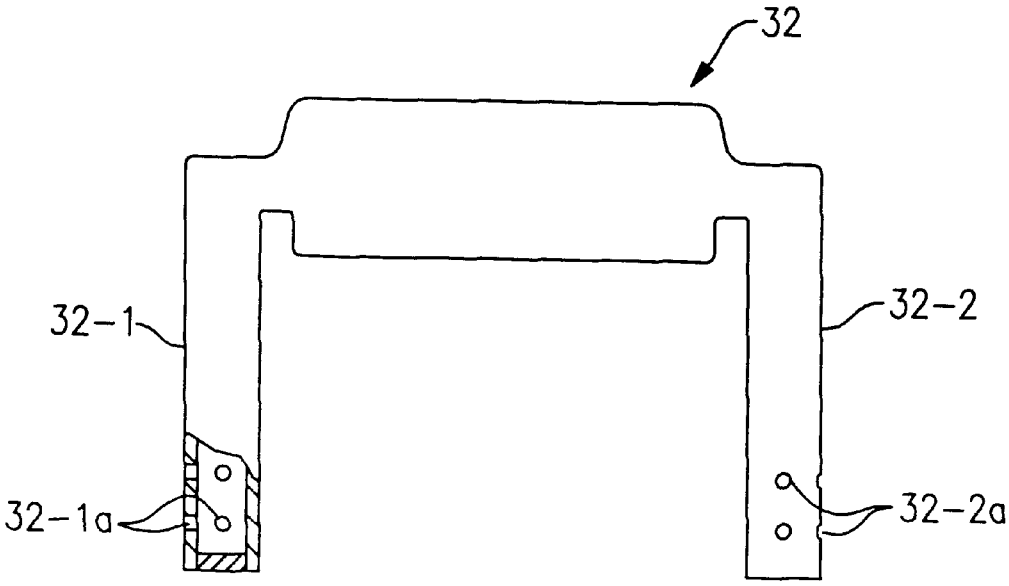
FIG. 4 is a partially cutaway view of the discharge muffler of the present invention.

Discharge port 28-2 in motor end bearing 28 is overlain by normally closed valve 29. Valve 29 is within and opens into muffler 32. As described so far, compressor 10 is generally conventional. The present invention differs in the details of muffler 32 and the resultant differences in operation of compressor 10. Referring specifically to FIGS. 3 and 4 it will be evident that muffler 32 differs from conventional mufflers in that it has two downwardly directed discharge tubes 32-1 and 32-2 which are blocked at their ends and which have a plurality of ports 32-1*a* and 32-2*a*, respectively, which are each located within the portion of the 180° perimeter of tubes 32-1 and 32-2 which is not directed towards the other one of discharge tubes 32-1 and 32-2 or pick up tube 34. The reason for these locations of ports 32-1*a* and 32-2*a* is to avoid discharging gas towards oil pick up tube 34. Referring specifically to FIG. 3, it will be noted that discharge tubes 32-1 and 32-2 extend into oil sump 36 and that all of ports 32-1*a* and 32-2*a* are located above the intake of oil pick up tube 34. This is to prevent the generation of foam from uncovering oil pick up tube 34 and thereby interfering with compressor lubrication.

Although two discharge tubes 32-1 and 32-2 are illustrated with each having a plurality of ports 32-1*a* and 32-2*a*, respectively, one discharge tube and any convenient number of ports may be employed. The critical consideration is to avoid unnecessary restrictions. Accordingly, the discharge tubes should have a combined cross section at least equal to that of discharge port 28-2 and the ports 32-1*a* and 32-2*a* should be at least 0.25 inches in diameter and have a total cross sectional area on the order of 1.2 to 1.5 times the area of discharge port 28-2.

Figure 5:
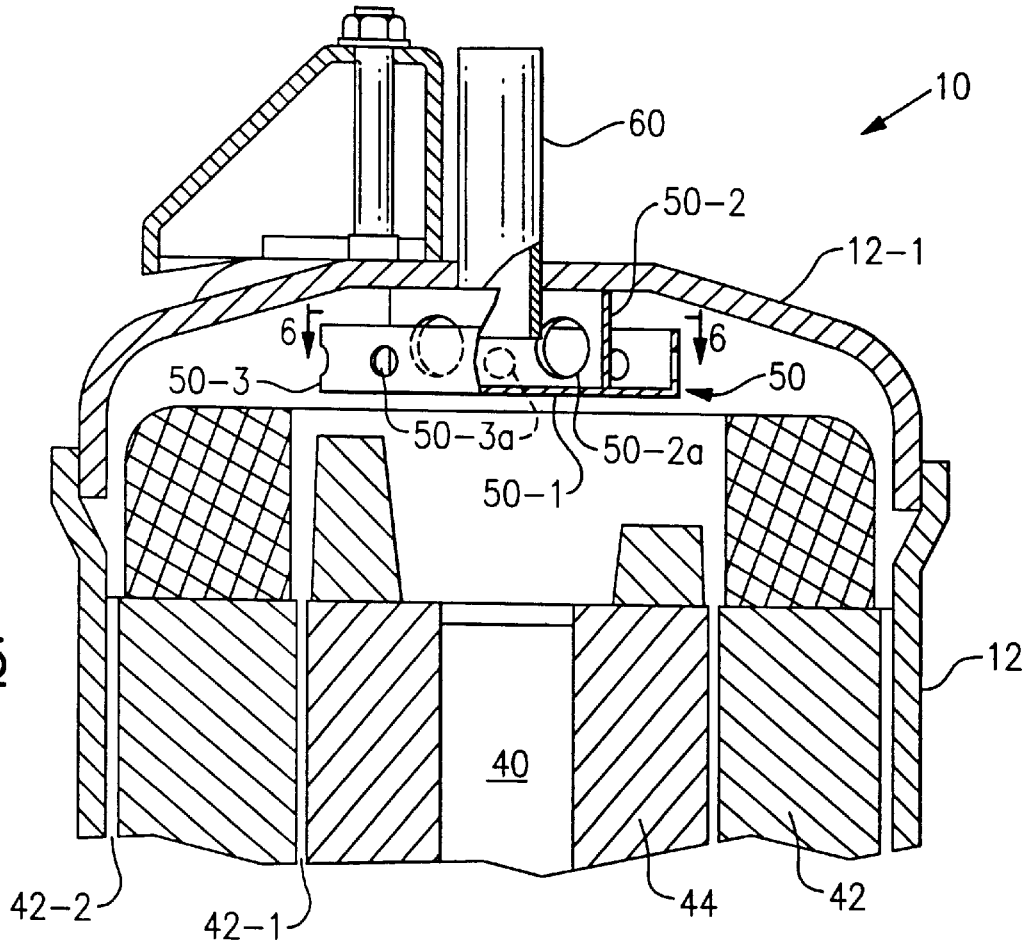
FIG. 5 is an enlarged view of a portion of FIG. 1.
Figure 6:
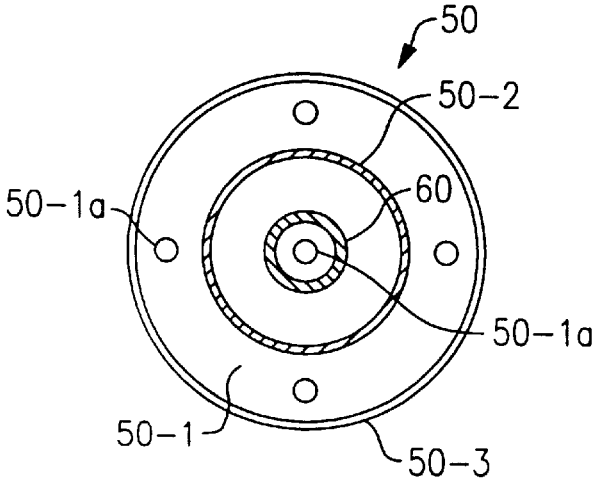
FIG. 6 is a sectional view taken along line 6—6 of FIG. 5.

As best shown in FIGS. 1, 5 and 6, an oil separator 50 is suitably secured to the top of the interior of shell 12 in a surrounding relationship to discharge line 60. Referring specifically to FIGS. 5 and 6, oil separator 50 includes: (1) a flat portion 50-1 facing rotor 44 and having a plurality of ports 50-1 a for oil drainage; (2) an inner annular wall member 50-2 having a plurality of ports 50-2*a* and being welded or otherwise suitably secured to the interior of shell 12; and, (3) outer annular wall member 50-3 having a plurality of ports 50-3*a* and being spaced from the interior of shell 12.

Initially, compressor 10 will be charged with oil up to, or a little above, the top surface of motor end bearing 28. During operation of compressor 10, some oil will be carried off to the refrigeration circuit due to the affinity between oil and refrigerant. The generation of foam by the discharge gas will temporarily remove oil from the sump as the foam moves into the space above motor end bearing 28. Foam will be continuously generated, collapsed and drained back into sump 36 but the oil level will drop due to the removal of oil as foam. To prevent the excess loss of oil due to foam generation, ports 32-1*a* and 32-2*a* must be located above the inlet of oil pick up tube 34 by a minimum of a quarter of an inch. If the level of oil in sump 36 drops below ports 32-1*a* and 32-2*a*, no foam is generated and compressor 10 will be noisier but will operate without problems as long as the oil is able to circulate for compressor lubrication.

Figure 2:
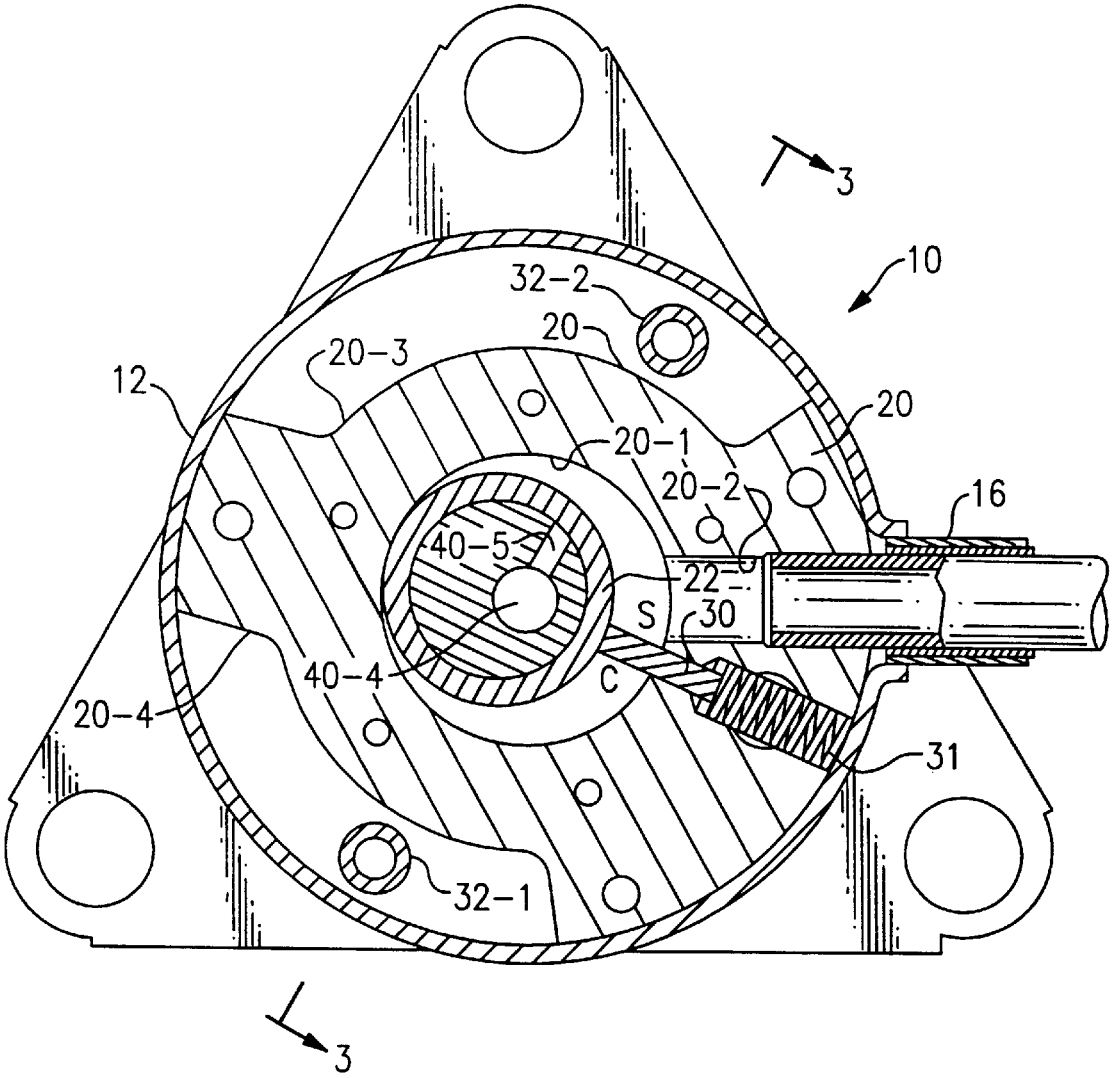
FIG. 2 is a sectional view taken along line 2—2 of FIG. 1.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. As best shown in FIG. 2, oil delivered to bore 40-4 is able to flow into a series of radially extending passages, in portion 40-1, eccentric 40-2, and portion 40-3 exemplified by passage 40-5 in eccentric 40-2, to lubricate bearing 24, piston 22, and bearing 28, respectively. The excess oil flows from bore 40-4 and either passes downwardly over the rotor 44 and stator 42 to the sump 36 or is carried by the gas flowing from the annular gap between rotor 44 and stator bore 42-1 and impinges and collects on the inside of cover 12-1 or oil separator 50 before draining to sump 36.

Piston 22 coacts with vane 30 in a conventional manner such that refrigerant gas is drawn through suction tube 16 and passageway 20-2 to suction chamber S. The gas in suction chamber S is compressed after suction chamber S has been cut off from suction tube 16 and has been transformed into a compression chamber C while a new suction chamber is being formed. The hot compressed gas in compression chamber C passes through discharge port 28-2 unseating discharge valve 29 and enters into the interior of muffler 32. The compressed gas divides in muffler 32 with part flowing into tube 32-1 and out ports 32-1*a* and part flowing into tube 32-2 and out ports 32-2*a*. The gas, at discharge pressure, passing from muffler 32 via ports 32-1*a* and 32-2*a* enters oil sump 36 which is also at discharge pressure. Depending upon the oil level in sump 36 and the location of ports 32-1*a* and 32-2*a* relative to the oil in sump 36, foam may or may not be generated. The passing of the hot discharge gas into oil sump 36 increases the temperature of the oil in sump 36 and tends to generate foam. Under certain operating conditions, such as those encountered in heat pump operation, the solubility of the refrigerant in the oil could be very high due to low ambient temperature. In such a case, the oil lubrication capability may be compromised but refrigerant solubility will be significantly reduced due to the heating of the oil thereby improving its lubricating effectiveness. Additionally, the discharge of the gas into the oil sump 36 produces a foam which has a greater volume than the oil forming the foam and so tends to flow through the passages defined by recessed portions 20-3 and 20-4 and the interior of shell 12, as best shown in FIG. 2. There will be a tendency for the lower shell, i.e. the portion of shell 12 below rotor 44 and stator 42 to fill with foam. Because the gas/liquid impedance is ineffective for sound transmission and because there is no direct path for sound to travel, the compressor 10 is quieter than conventional compressors. If ports 32-1*a* and 32-2*a* are located above the surface of the oil in sump 36, no foam will be generated but the oil will be heated by the hot discharge gas thereby improving the lubricating effectiveness of the oil.

If excessive oil passes from compressor 10 with the discharge gas it can interfere with heat transfer in the refrigeration system and can leave an inadequate amount of oil in oil sump 36 for proper lubrication. The presence of foam greatly increases the amount of oil present with the discharge gas. The discharge gas must however go past the motor and this can only be done by passing through the clearance between rotor 44 and stator bore 42-1 or by passing through the slots or grooves 42-2 in the outer surface of stator 42. Because the clearance between rotor 44 and stator bore 42-1 is small and because the relative movement of rotor 44 with respect to stator 42 results in a shearing force on any foam bubbles entering the clearance, the foam tends to collapse in passing between the rotor 44 and stator 42. Additionally, the relative rotation of rotor 44 with respect to stator 42 tends to cause the discharge gas to move in a spiral path that tends to centrifugally remove oil from the gas. The swirling flow tends to persist into the space between rotor 44 and discharge line 60. Oil separator 50 tends to collect oil and prevents its being entrained with the gas passing from compressor 10 through discharge line 60 to the condenser 70 of the refrigeration circuit. Specifically, refrigerant, oil and any remaining foam passing between rotor 44 and stator 42 tends to be moving in a spiral path which tend to move any oil outward. The refrigerant and any entrained oil will flow either through ports 50-3*a* or between wall member 50-3 and the interior of shell 12 before passing through ports 50-2*a* and the changes in flow direction will tend to separate out entrained oil which will drain through drainage ports 50-1*a*. The refrigerant and any entrained oil passing through ports 50-2*a* will undergo a change in flow direction prior to flowing into discharge line 60 which will tend to separate out entrained oil which will drain through drainage ports 50-1*a*. The oil draining through drainage ports 50-1*a* will tend to fall into the swirling flow passing between rotor 44 and stator 42 and will thereby be directed towards the interior of casing 12. While discharge gas may flow past stator 42 via grooves 42-2, it is more likely to be the location of return oil flow to sump 36 given the fact that there is no pressure gradient so that gravity flow of the oil will take place and because of the centrifugal effect on oil in the gap between rotor 44 and stator bore 42-1.

Although the present invention has been illustrated and described in terms of a vertical, high side, variable speed compressor, other modifications will occur to those skilled in the art. For example, the invention is applicable to both horizontal and vertical compressors. The only significant difference would be the location of the oil sump relative to the muffler and the discharge from the muffler could be straight down into the portion of the oil sump between the pump structure and the stator which would be well removed from the appropriate oil pick up tube. It is therefore intended that the present invention is to be limited only by the scope of the appended claims.

What is claimed is:

1. In a refrigeration system containing refrigerant and serially including a high side rotary compressor, a condenser, expansion means and an evaporator, said compressor comprising:

shell means having a first end and a second end;

cylinder means containing pump means including a vane and a piston coacting with said cylinder means to define suction and compression chambers;

said cylinder means being fixedly located in said shell means near said first end;

first bearing means secured to said cylinder means and extending towards said first end;

second bearing means secured to said cylinder means and extending towards said second end;

a discharge port in said second bearing means;

a normally closed discharge valve controlling flow through said discharge port, an oil sump located at the lowest portion of said shell means and containing oil therein; and muffler means for directing at least a major portion of the discharge flow passing through said discharge port into said oil in said oil sump whereby said oil is heated and foam is generated.

2. The compressor of claim 1 wherein:

said compressor is a vertical compressor; and said oil sump is located beneath said pump means.

3. The compressor of claim 1 wherein said muffler means includes at least one discharge tube having a blocked end and at least one port along its length.

4. The compressor of claim 1 further including means for oil separation secured to and located within said shell means at said second end and forming a portion of a discharge flow path leading to said condenser.

* * * * *